US009289996B2

(12) United States Patent
Suzuki et al.

(10) Patent No.: US 9,289,996 B2
(45) Date of Patent: Mar. 22, 2016

(54) INKJET RECORDING APPARATUS

(75) Inventors: Kazuo Suzuki, Yokohama (JP); Masaya Uetsuki, Yokohama (JP); Toshimitsu Danzuka, Tokyo (JP); Masataka Kato, Yokohama (JP); Tsuyoshi Ibe, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 13/341,008

(22) Filed: Dec. 30, 2011

(65) Prior Publication Data

US 2012/0176438 A1 Jul. 12, 2012

(30) Foreign Application Priority Data

Jan. 6, 2011 (JP) ..... 2011-001313

(51) Int. Cl.

*B41J 2/165* (2006.01)
*B41J 2/195* (2006.01)
*B41J 29/377* (2006.01)
*B41J 29/38* (2006.01)

(52) U.S. Cl.

CPC ..... *B41J 2/16535* (2013.01); *B41J 2/195* (2013.01); *B41J 29/377* (2013.01); *B41J 29/38* (2013.01); *B41J 2002/1655* (2013.01)

(58) Field of Classification Search

CPC ..... B41J 2/165; B41J 29/38; B41J 2/04563; B41J 2/0458; B41J 2/04528; B41J 2/1652; B41J 2/04541; B41J 2/04553; B41J 2002/1655
USPC ..... 347/17, 22, 23, 33
See application file for complete search history.

(56) References Cited

U.S. PATENT DOCUMENTS

| | | | | |
|---|---|---|---|---|
| 5,678,134 | A * | 10/1997 | Miki et al. | 399/71 |
| 6,672,704 | B2 * | 1/2004 | Katakura et al. | 347/23 |
| 6,692,100 | B2 | 2/2004 | Steinfield et al. | |
| 7,182,424 | B2 * | 2/2007 | Kubota | 347/19 |
| 7,350,894 | B2 * | 4/2008 | Takeuchi | 347/16 |
| 7,770,518 | B2 * | 8/2010 | Barinaga et al. | 101/425 |
| 7,798,598 | B2 * | 9/2010 | Horie | 347/33 |
| 2007/0109351 | A1 * | 5/2007 | Mitsuzawa | 347/40 |
| 2007/0242121 | A1 * | 10/2007 | Kersey et al. | 347/101 |
| 2008/0136857 | A1 * | 6/2008 | Ogasawara et al. | 347/18 |
| 2009/0009556 | A1 * | 1/2009 | Takahashi et al. | 347/33 |
| 2010/0053260 | A1 * | 3/2010 | Burmeister et al. | 347/33 |
| 2010/0302297 | A1 * | 12/2010 | Suzuki et al. | 347/14 |

FOREIGN PATENT DOCUMENTS

JP 2006-341570 A1 12/2006

* cited by examiner

*Primary Examiner* — Julian Huffman
(74) *Attorney, Agent, or Firm* — Canon U.S.A., Inc. IP Division

(57) ABSTRACT

An inkjet recording apparatus that suppresses temperature rising of a recording head to decrease standby time when the recording head is high in temperature, thereby reducing a drop in recording speed and degradation in image quality. The inkjet recording apparatus includes a recording head configured to have a discharge port surface in which a discharge port for discharging ink is formed, a temperature sensor configured to detect temperature of the recording head, and a cleaning unit configured to make contact with the recording head to clean the discharge port surface. The inkjet recording apparatus controls whether to make the cleaning unit contact the discharge port surface based on the recording head temperature detected by the temperature sensor.

10 Claims, 20 Drawing Sheets

INKJET RECORDING APPARATUS

BACKGROUND OF THE INVENTION

1. Field of the Invention

The present invention relates to an inkjet recording apparatus that discharges ink from a recording head to a recording material for recording.

2. Description of the Related Art

Inkjet recording apparatuses each have a recording head that has a discharge port forming surface (hereinafter, referred to as a discharge port surface) in which discharge ports (nozzles) are formed. It has been known that a normal discharge operation of an inkjet recording apparatus can be hindered by adhesion of ink to a discharge port surface.

Some recording apparatuses each form an image by using inks that are mutually reactive or a reaction liquid and ink in combination. It has also been known to use ultraviolet rays, microwaves, and/or heat to solidify ink for improved toughness. In such cases, ink adhering to a discharge port surface is particularly difficult to remove, which has been known to be a serial hindrance to discharge operations.

Various cleaning operations may be needed in order to solve the problems.

To solve the situation that a wet discharge port surface can cause a discharge failure, inkjet recording apparatuses typically include a wiping member, called wiper, which wipes a discharge port surface. Using a wiping member, inkjet recording apparatuses perform the operation of wiping adherent ink mist off a discharge port surface at appropriate timing (wiping operation).

As an example of such a wiping operation, there is discussed a method of determining the timing to perform a wiping operation based on a combination of a timer and a count of the number of ink droplets discharged from a recording head (dot count). Another method discussed is to determine the timing for performing a wiping operation based on a combination of an ordinary dot count and a recording duty (printing ratio).

Wiping performance may drop due to various reasons. Examples include the thickening of ink mist adhering to a discharge port surface due to evaporation of an ink solvent, a high temperature of a recording head, and an extended time of recording operation that precludes a wiping operation during the recording operation.

In such cases, a wiper may be moistened in advance with a wiping solution containing an undiluted or diluted solution of the ink or other solvents or mixtures thereof before a wiping operation. U.S. Pat. No. 6,692,100 discusses a method of cleaning using a belt-like wiping member.

Inkjet recording apparatuses of thermal type may have a problem of degraded ink discharge performance and/or shorter head life due to temperature rising of a recording head during discharge operations. Japanese Patent Application Laid-Open No. 2006-341570 discusses a method of providing a standby time in a recording operation depending on the head temperature. The problem with temperature rising of a recording head may also affect inkjet recording apparatuses that include a mechanism for drying a recording surface of a recording material, as well as inkjet recording apparatuses of thermal type.

The provision of a standby time depending on the head temperature, as discussed in Japanese Patent Application Laid-Open No. 2006-314570, has a disadvantage of lower recording speed. A standby time can be provided in only a portion of a page of recording surface to record. In such a case, that portion of the page differs from the other recording portions in the state of ink impact and permeability, so that image unevenness may occur over the recording surface.

SUMMARY OF THE INVENTION

The present invention is directed to an inkjet recording apparatus that can suppress temperature rising of a recording head to extend the life of the recording head.

According to an aspect of the present invention, an inkjet recording apparatus includes: a recording head configured to have a discharge port surface in which a discharge port for discharging ink is formed; a temperature detection unit configured to detect temperature of the recording head; a cleaning unit configured to make contact with the recording head to clean the discharge port surface; and a control unit configured to control whether to make the cleaning unit contact the discharge port surface based on the temperature of the recording head detected by the temperature detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
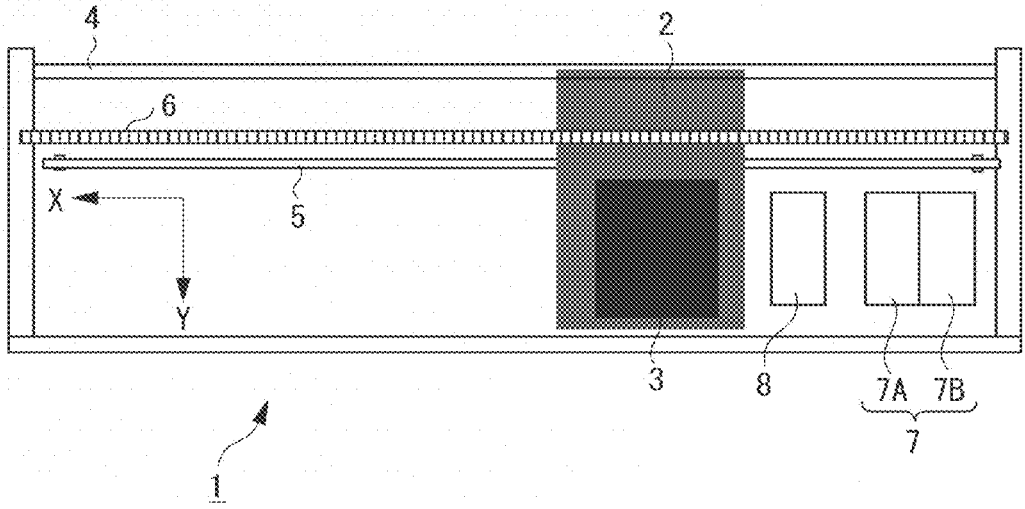
FIG. 1 is a plan view illustrating an inkjet recording apparatus according to a first exemplary embodiment.

FIG. 1 is a plan view illustrating an inkjet recording apparatus according to a first exemplary embodiment. As illustrated in FIG. 1, the inkjet recording apparatus according to the present exemplary embodiment includes an apparatus main body 1. The apparatus main body 1 includes various types of mechanism units including a recording-material conveyance system unit (not illustrated).

The inkjet recording apparatus according to the present exemplary embodiment is a serial type inkjet recording apparatus. The serial type inkjet recording apparatus performs a recording operation by intermittently conveying a recording material in a Y direction (sub scanning direction) with the conveyance system unit while moving recording heads 3 in an X direction (main scanning direction) orthogonal to the Y direction.

As illustrated in FIG. 1, the apparatus main body 1 has a large size in the X direction so that recording can be performed on a recording material of a relatively large format such as A1 size.

As illustrated in FIG. 1, the apparatus main body 1 includes a carriage 2 on which recording heads 3 are detachably mounted. The carriage 2 reciprocates in the X direction with the recording heads 3.

More specifically, the carriage 2 is supported so as to be movable along a guide shaft 4 that is arranged in the X direction. The carriage 2 is fixed to an endless belt 5 that moves generally in parallel with the guide shaft 4. The endless belt 5 is driven to reciprocate by a carriage motor (CR motor), and thereby moves the carriage 2 to reciprocate in the X direction.

Figure 2:
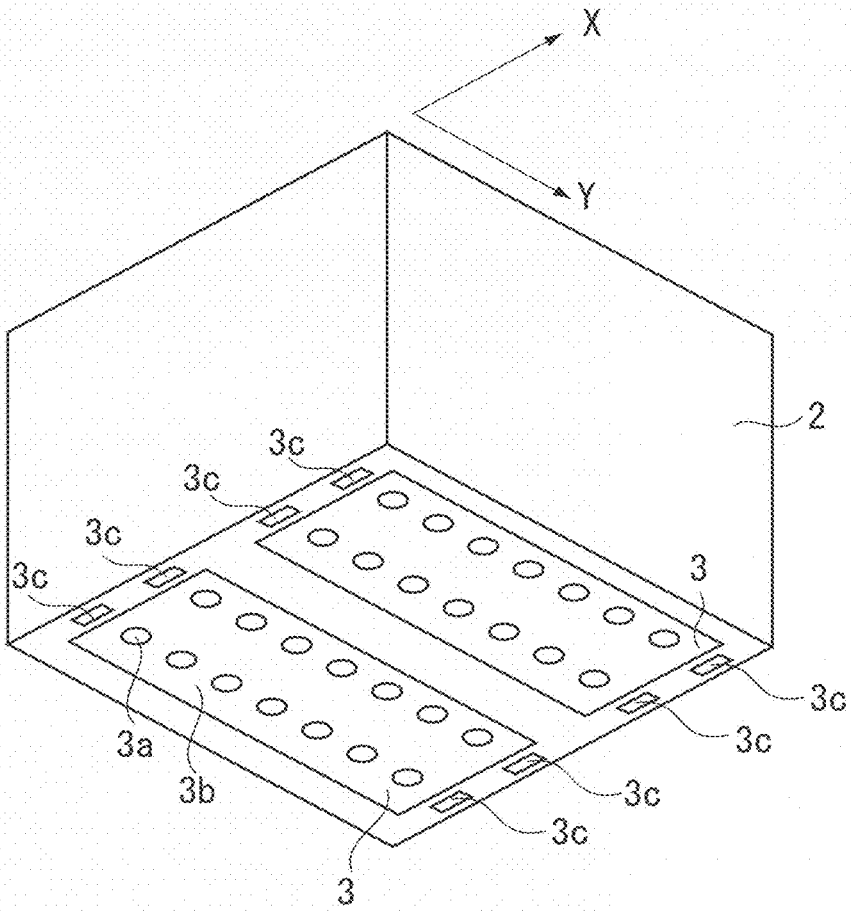
FIG. 2 is a perspective view illustrating a carriage on which recording heads according to the first exemplary embodiment are mounted.

FIG. 2 is a perspective view illustrating the carriage 2 on which a plurality of recording heads 3 is mounted. As illustrated in FIG. 2, the recording heads 3 each include a plurality of discharge ports 3*a*, a plurality of liquid channels (not illustrated), and a common liquid chamber (not illustrated). The discharge ports 3*a* are formed in a discharge port surface 3*b*. The liquid channels are formed to correspond to the respective discharge ports 3*a*. The common liquid chamber feeds ink to the plurality of liquid channels.

Each recording head 3 according to the present exemplary embodiment includes 1280 discharge ports 3*a* intended for an ink of the same color. The 1280 discharge ports 3*a* are arranged in the sub scanning direction, the Y direction, at a density of 1200 dots per inch (dpi).

Energy generating elements are arranged on the respective liquid channels of the recording heads 3. The energy generating elements generate discharge energy for discharging ink from the discharge ports 3*a*. In the present exemplary embodiment, electrothermal transducers are used as the energy generating elements. The electrothermal transducers locally heat ink to cause film boiling so that the ink is discharged with that pressure. In the following description, the discharge ports 3*a* and the liquid channels will be referred to collectively as nozzles.

The recording heads 3 mounted on the carriage 2 are supplied with inks containing respective different color materials from ink tanks. In the present exemplary embodiment, the apparatus main body 1 includes four ink tanks (not illustrated) which accommodate four types of inks containing cyan, magenta, yellow, and black color materials, respectively.

The ink tanks of the apparatus body 1 are connected to respective corresponding ink supply ports of the recording heads 3 with tubes (not illustrated). Through the tubes, the inks are supplied from the ink tanks to the recording heads 3.

An arbitrary ink set may be used depending on the characteristics of the apparatus main body 1. The types (whether dyes or pigments, and colors) of the inks to be used are not limited thereto in particular.

The carriage 2 includes a plurality of temperature sensors 3*c* as temperature detection units for detecting the temperatures of the recording heads 3 and the vicinities of the recording heads 3. The temperature sensors 3*c* are arranged at both ends of each nozzle array of each color in the recording heads 3. Temperatures detected by temperature sensors 3*c* at both ends of each nozzle array are averaged to calculate the temperature of the nozzle array.

As illustrated in FIG. 1, the apparatus main body 1 includes a recovery processing device 7 to maintain favorable ink discharge performance of the discharge ports 3*a* of the recording heads 3. The recovery processing device 7 is held and fixed to a predetermined position inside the apparatus main boy 1. The recovery processing device 7 includes suction recovery mechanisms 7 (7A and 7B).

The suction recovery mechanisms 7A and 7B perform suction recovery processing, a mode of recovery processing. The suction recovery processing refers to processing of forcefully suction ink from a plurality of nozzles formed in a recording head 3 to replace the ink in the nozzles with ink that is suitable for discharge.

More specifically, the suction recovery mechanisms 7A and 7B cover a discharge port surface 3*b* with a cap, generate a negative pressure in the cap by using a pump (not illustrated) that communicates with the cap, and forcefully suction ink from discharge ports 3*a* with the negative pressure. The suction recovery mechanisms 7A and 7B perform the suction recovery processing on three groups of nozzle arrays each.

Figure 3:
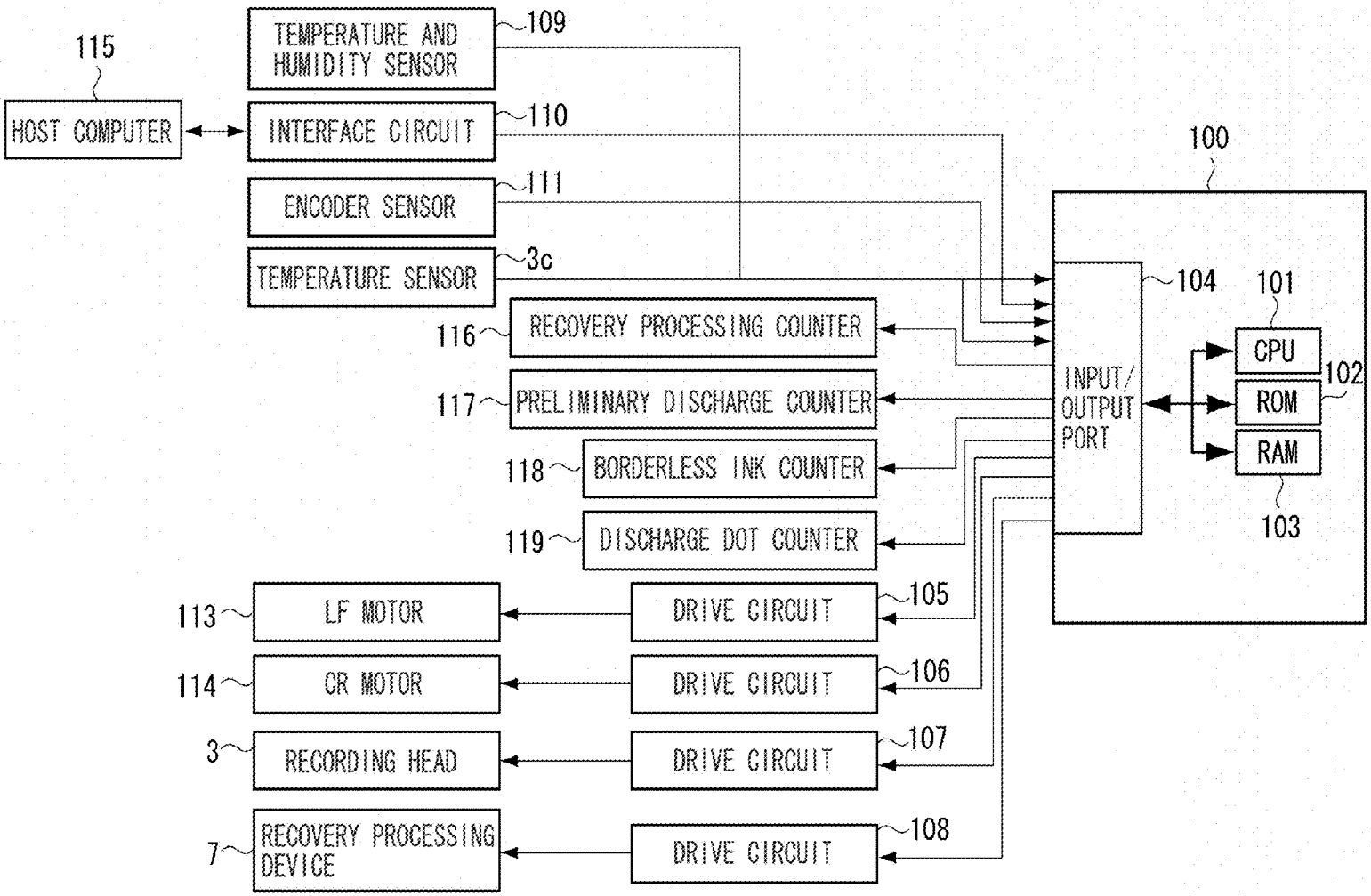
FIG. 3 is a block diagram illustrating a configuration of a control system according to the first exemplary embodiment.

FIG. 3 is a block diagram illustrating a configuration of a control system that the apparatus main body 1 of the inkjet recording apparatus according to the present exemplary embodiment includes as a control unit. As illustrated in FIG. 3, the control system includes a main control unit 100. The main control unit 100 includes a central processing unit (CPU) 101 and a read-only memory (ROM) 102. The CPU 101 performs calculation, control, determination, setting, and other processing operations. The ROM 102 contains a control program to be executed by the CPU 101.

The main control unit 100 also includes a random-access memory (RAM) 103 and an input/output port 104. The RAM 103 is used as a buffer for storing binary recording data that indicates whether to discharge ink, and as a work area for the processing by the CPU 101.

The input/output port 104 is connected with drive circuits 105, 106, 107, and 108 for driving a line feed motor (LF motor) 113 of a conveyance unit, a carriage motor (CR motor) 114, the recording heads 3, and the recovery processing device 7. The input/output port 104 is also connected with the temperature sensors 3*c* for detecting the temperatures of the recording heads 3, and an encoder sensor 111 fixed to the carriage 2.

The input/output port 104 is also connected with other sensors including a temperature and humidity sensor 109. The temperature humidity sensor 109 detects temperature and humidity, which are the use environment of the apparatus main body 1. The main control unit 100 is connected to a host computer 115 through an interface circuit 110.

The control system includes a recovery processing counter 116. The recovery processing counter 116 counts the amount of ink when the recovery processing device 7 forcefully discharges ink from a recording head 3. The control system also includes a preliminary discharge counter 117. The preliminary discharge counter 117 counts the amount of ink that is preliminarily discharged before starting a recording operation, when ending a recording operation, and during a recording operation.

The control system also includes a borderless ink counter 118 and a discharge dot counter 119. The borderless ink counter 118 counts the amount of ink that is recorded outside the area of a recording material when performing borderless recording. The discharge dot counter 119 counts the amount of ink that is discharged during a recording operation.

Next, a recording operation to be performed by the inkjet recording apparatus having the above-described configuration will be described.

The inkjet recording apparatus receives recording data from the host computer 115 through the interface circuit 110, and develops the recording data in a buffer in the RAM 103. When an instruction for a recording operation is given, the conveyance unit (not illustrated) is activated to feed a recording material to a position where the recording material is opposed to the recording heads 3.

The carriage 2 moves in the X direction along the guide shaft 4. As the carriage 2 moves, the recording heads 3 discharge ink droplets, whereby a band of image is recorded on a recording surface of the recording material with the ink droplets.

The conveyance unit then conveys the recording material for one band in the Y direction that is orthogonal to the X direction. The above-described operation is repeated to form a predetermined image on the recording material.

The position of the carriage 2 is detected by the main control unit 100 by counting a pulsed signal that is output from the encoder sensor 111 with the movement of the carriage 2. More specifically, the apparatus main body 1 includes an encoder film 6 (see FIG. 1) arranged in the X direction. The encoder film 6 has detection portions at regular intervals. The encoder sensor 111 detects the detection portions and outputs a pulsed signal to the main control unit 100.

The main control unit 100 counts the pulsed signal to detect the position of the carriage 2. The carriage 2 is moved to its home position and other positions based on the pulsed signal from the encoder sensor 111.

A wiping mechanism 8 is a mechanism for wiping and cleaning the discharge port surfaces 3*b* of the recording heads 3 with a cleaning web 30. Examples of the cleaning web 30 include unwoven fabrics of polyolefin, polyethylene terephthalate, and nylon.

Figure 4:
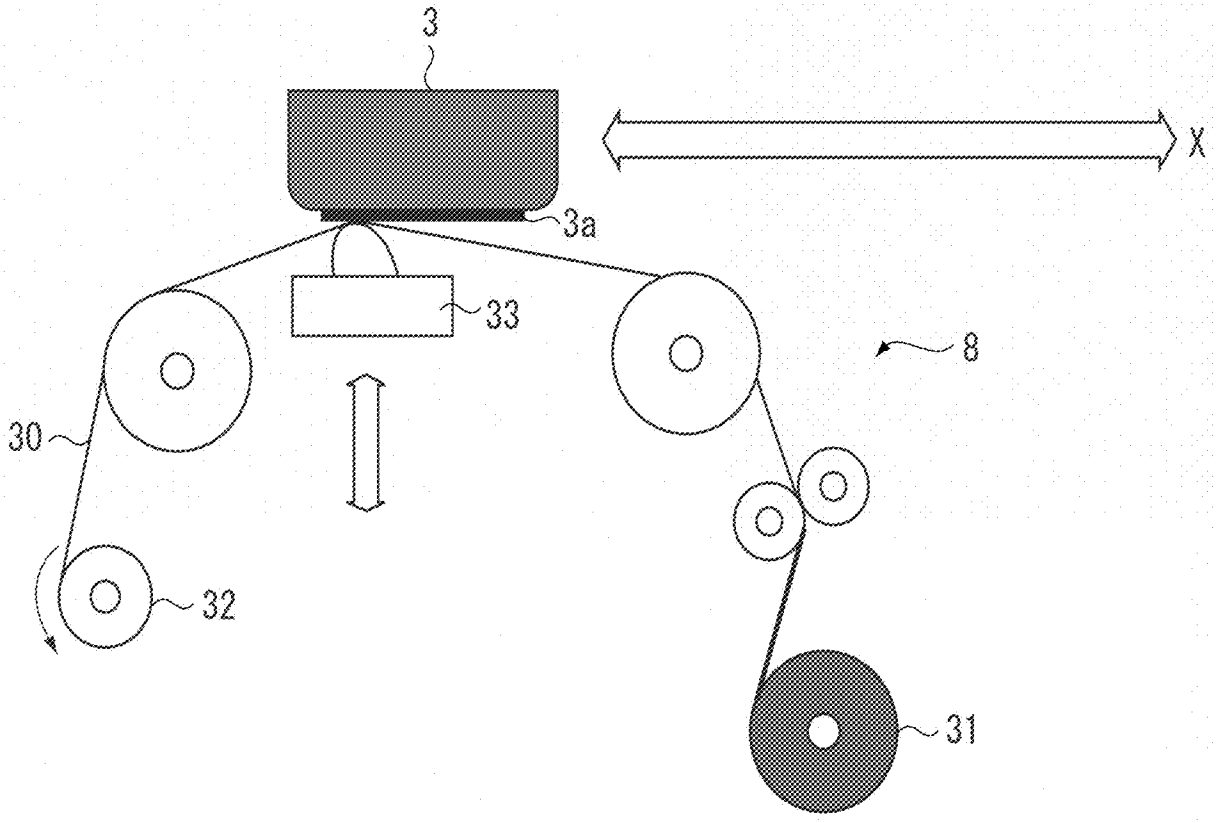
FIG. 4 is a schematic diagram illustrating a wiping mechanism according to the first exemplary embodiment.

FIG. 4 is a schematic diagram illustrating a recording head 3 and the wiping mechanism 8 as seen from the front of the apparatus main body 1. As illustrated in FIG. 4, the wiping mechanism 8 holds the cleaning web 30 across a plurality of groups of rollers and an abutting member 33. The wiping mechanism 8 moves the abutting member 33 up and down to control whether to make the cleaning web 30 contact the recording head 3.

The contact position between the recording head 3 and the cleaning web 30 lies within the scanning range of the recording head 3. When the recording head 3 performs scanning, the discharge port surface 3*b* is wiped with the cleaning web 30.

When wiping the discharge port surface 3*b*, the cleaning web 30 is stained with wiped ink. A feed roller 31 and a winding roller 32 can be rotated at appropriate timing so that the discharge port surface 3*b* is wiped with an unstained surface of the cleaning web 30.

Figure 5:
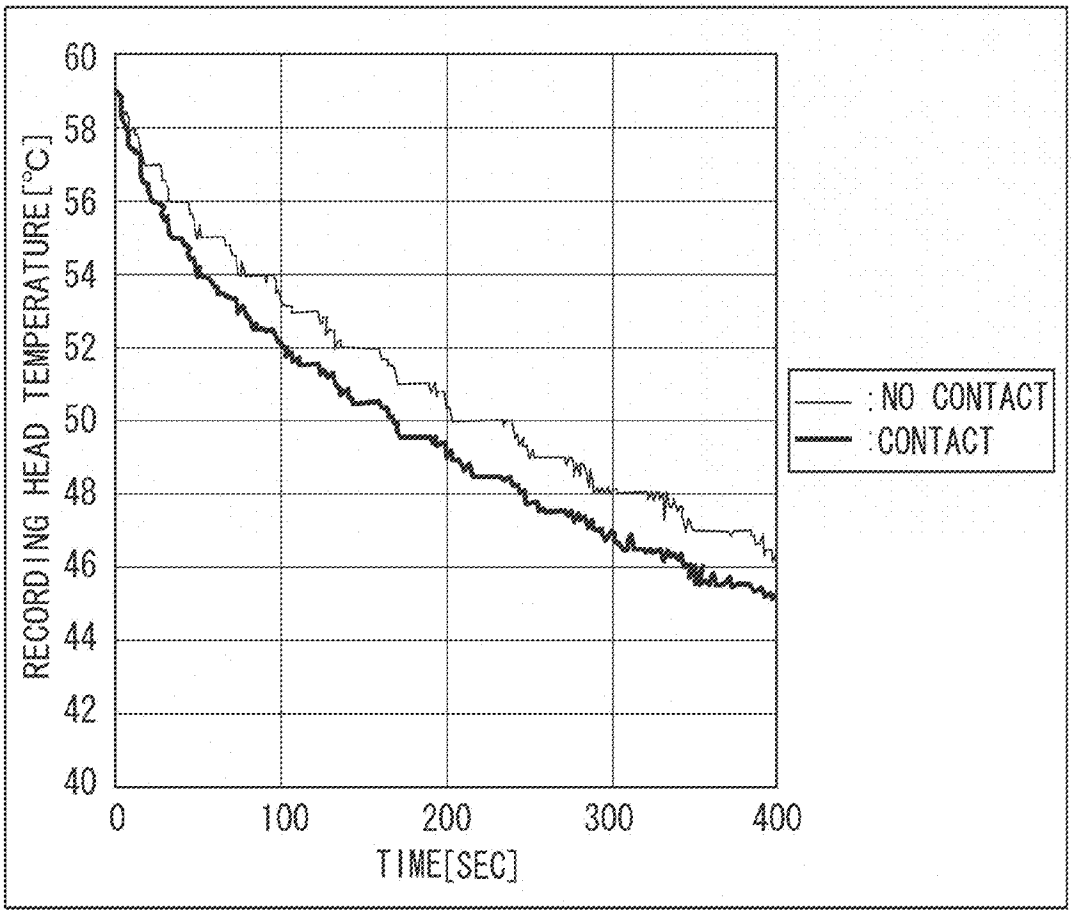
FIG. 5 is a graph illustrating temperature drops of a recording head according to the first exemplary embodiment.

The inventors have made a study and found that the contact of the wiping mechanism 8 with a recording head 3 can promote heat dissipation and lower the temperature of the recording head 3. FIG. 5 illustrates the result of study.

As illustrated in FIG. 5, when the wiping mechanism 8 was put into contact with a recording head 3, the time needed to lower the temperature of the recording head 3, e.g., from 60° C. to 50° C. was reduced to approximately ¾ as compared to when the wiping mechanism 8 made no contact with the recording head 3.

Figure 6:
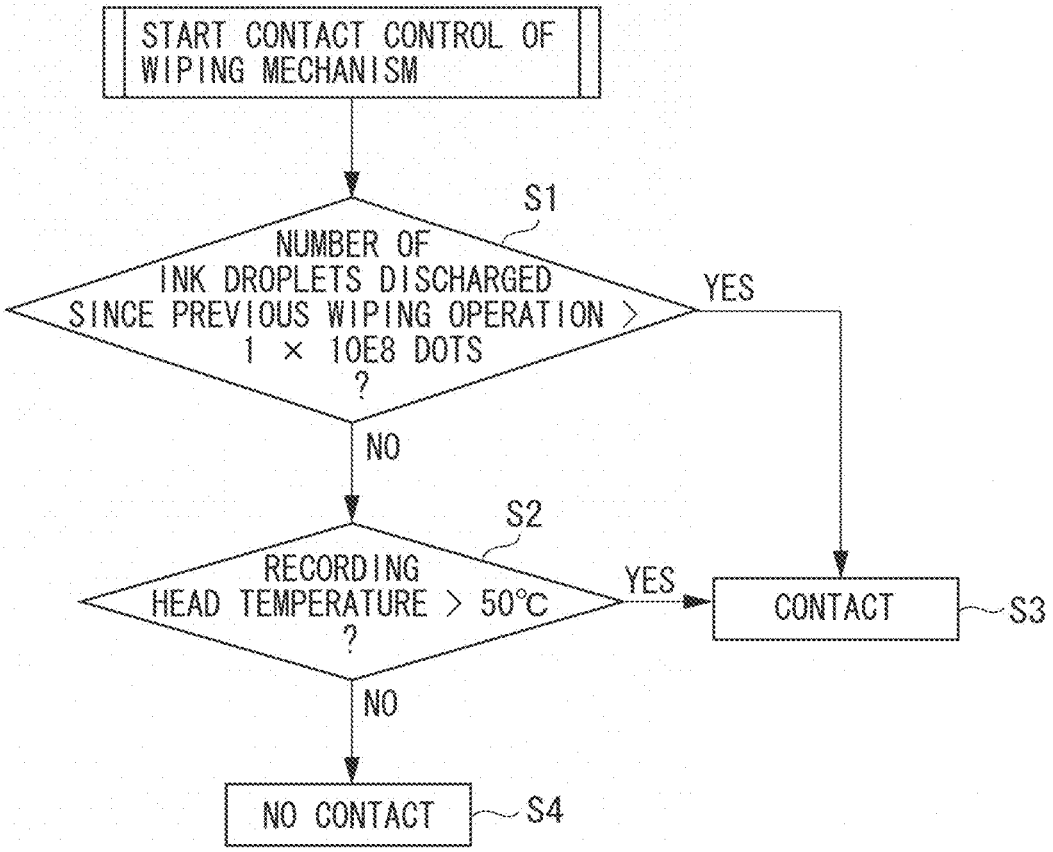
FIG. 6 is a flowchart illustrating a contact control method of the wiping mechanism according to the first exemplary embodiment.

Based on the result of study, in the present exemplary embodiment, the main control unit 100 determines whether to make the wiping mechanism 8 contact a recording head 3 for each scanning according to a flowchart illustrated in FIG. 6.

In step S1, the main control unit 100 predicts stains on a recording head 3 based on the number of discharged ink droplets, and determines whether the wiping mechanism 8 needs to contact with the recording head 3. In step S1, if the main control unit 100 determines that the wiping mechanism 8 needs to contact with the recording head 3 (YES in step S1), then in step S3, the main control unit 100 controls the wiping mechanism 8 to contact with the recording head 3.

Otherwise (NO in step S1), then in step S2, the main control unit 100 determines based on the temperature of the recording head 3 whether the wiping mechanism 8 needs to make contact in order to suppress temperature rising of the recording head 3. In step S2, if the main control unit 100 determines that the wiping mechanism 8 needs to contact the recording head 3 (YES in step S2), then the processing proceeds to step S3. Otherwise (NO in step S2), the processing proceeds to step S4, and the processing is ended without making the wiping mechanism 8 contact the recording head 3.

Figure 7:
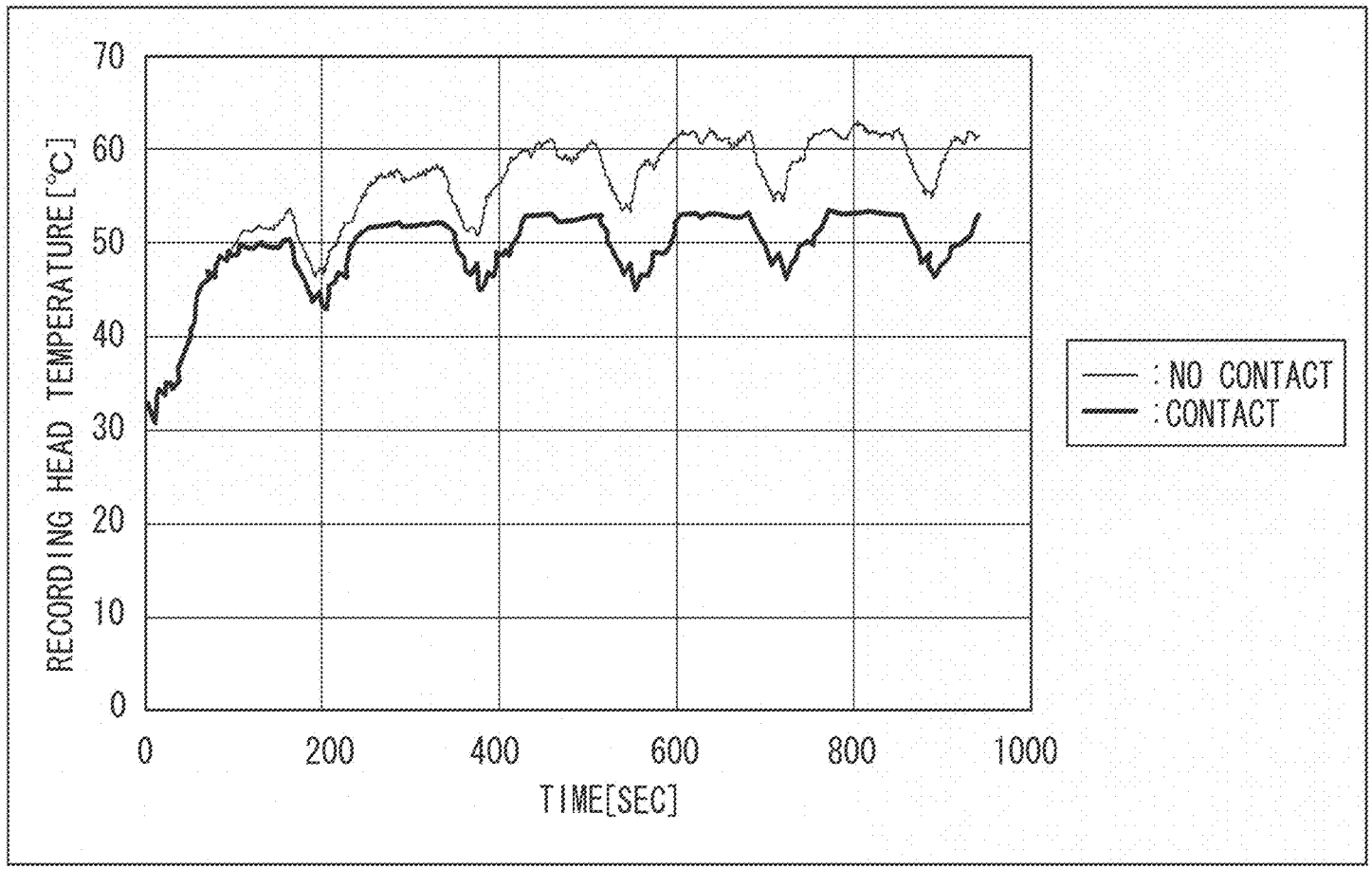
FIG. 7 is a graph illustrating temperature changes of a recording head according to the first exemplary embodiment.

FIG. 7 is a graph illustrating temperature changes of a recording head 3 with and without a temperature rising suppression control on the recording head 3. As illustrated in FIG. 7, with the temperature rising suppression control on the recording head 3, the rising in the temperature of the recording head 3 could be suppressed as compared to that without the control. As a result, it was possible to reduce ink adhesion to the recording head 3 and suppress thermal degradation of the recording head 3 for extended head life.

The temperature rising suppression control also eliminates the need for a standby control at a high temperature, such as waiting for a predetermined time when a recording head 3 reaches a predetermined temperature in order to reduce ink adhesion to the recording head 3, and suppress thermal degradation of the recording head 3. Consequently, the present exemplary embodiment can shorten the recording operation time and suppress a drop in recording speed.

While the present exemplary embodiment has dealt with the case of using the cleaning web 30, other cleaning units such as a wiper may be used to control contact with a recording head 3.

A second exemplary embodiment is an application example of the first exemplary embodiment. Description will be omitted where the portions of the second exemplary embodiment are the same as those of the first exemplary embodiment.

Depending on recording conditions and ambient conditions, temperature rising of a recording head 3 may be greater. In the present exemplary embodiment, the main control unit 100 not only controls whether to make the wiping mechanism 8 contact a recording head 3 but also controls the duration of the contact of the wiping mechanism 8 therewith based on the temperature of the recording head 3.

Figure 8:
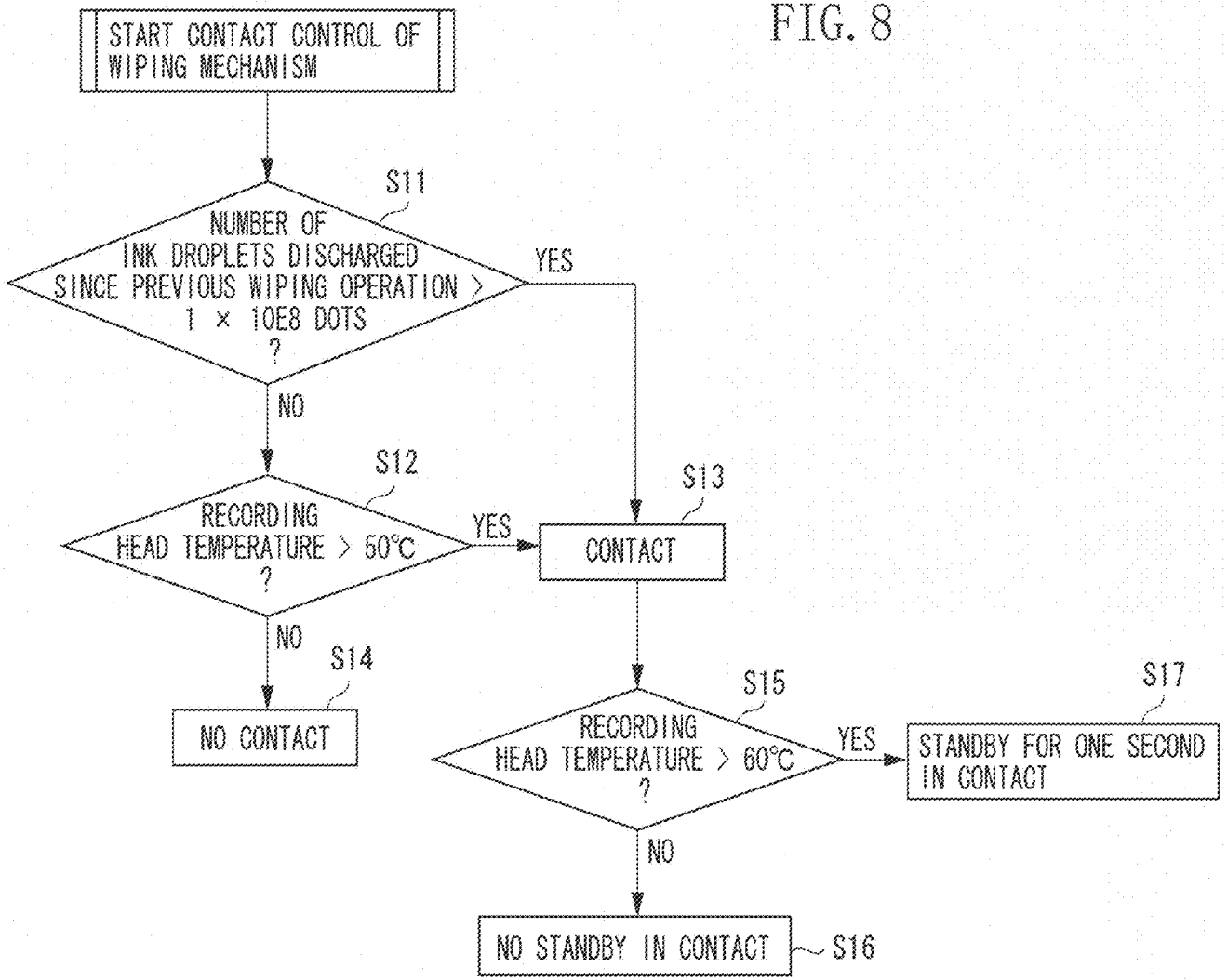
FIG. 8 is a flowchart illustrating a contact control method of a wiping mechanism according to a second exemplary embodiment.
Figure 9:
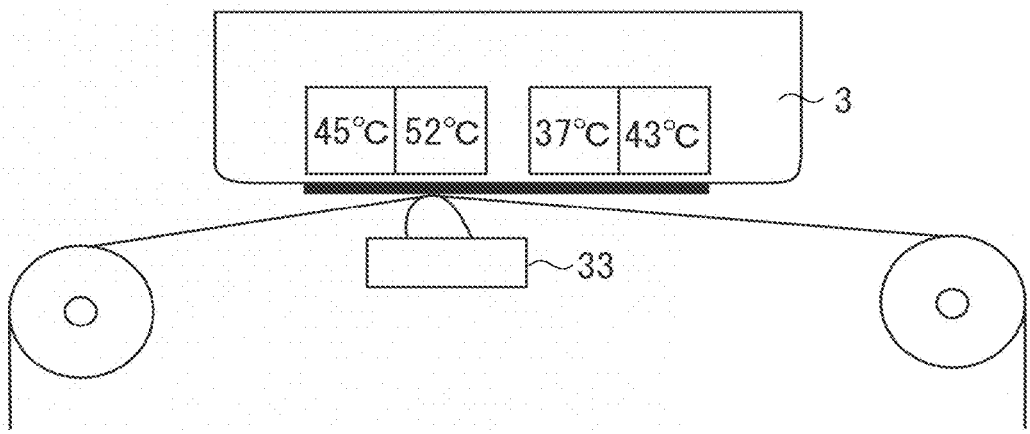
FIG. 9 is a schematic diagram illustrating the wiping mechanism according to the second exemplary embodiment.
Figure 9:
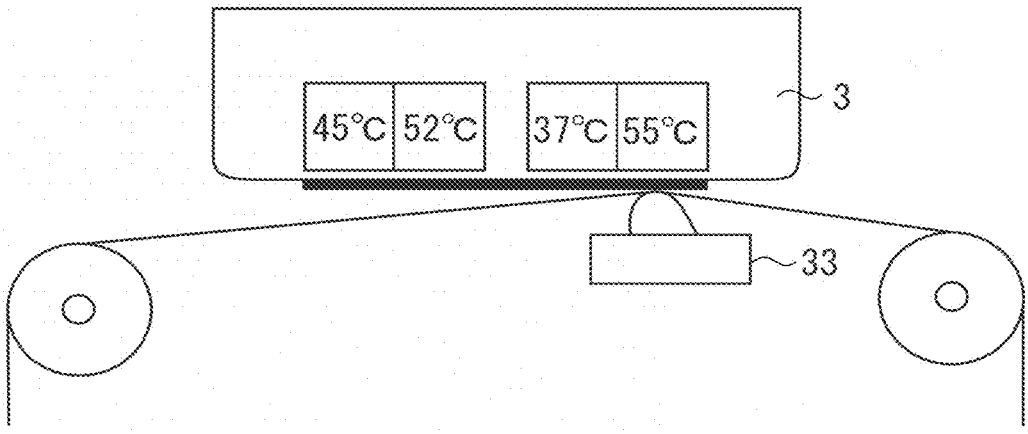

FIG. 8 is a flowchart illustrating a control according to the present exemplary embodiment. FIG. 9 is a schematic diagram illustrating the wiping mechanism 8 according to the second exemplary embodiment.

In step S11, the main control unit 100 determines whether to make the wiping mechanism 8 contact with a recording head 3 based on the number of discharged ink droplets. In step S12, the main control unit 100 determines whether to make the wiping mechanism 8 contact the recording head 3 based on the temperature of the recording head 3.

If it is determined to make the wiping mechanism 8 contact the recording head 3 (YES in step S11 or YES in step S12), then the processing proceeds to steps S13 and S15. In step S15, the main control unit 100 determines whether to wait for one second with the wiping mechanism 8 in contact with the recording head 3, based on the temperature of the recording head 3. If the main control unit 100 determines to wait for one second (YES in step S15), the processing proceeds to step S17 and wait for one second otherwise (NO in step S15), the processing proceeds to step S16. In step S16, the processing is ended without waiting for one second.

In the present exemplary embodiment, whether to make the wiping mechanism 8 contact a recording medium 3 and the duration of the contact of the wiping mechanism 8 are controlled based on the temperature of the recording head 3. This enables effective suppression of temperature rising of the recording heads 3.

When entering a standby with the wiping mechanism 8 in contact with a recording head 3, the main control unit 100 may control the standby position so that the wiping mechanism 8 is in contact with the vicinity of a nozzle array of a color that is the highest in temperature among the recording heads 3 as illustrated in FIG. 9. Such a control on the standby position further improves the effect of suppressing temperature rising of the recording heads 3.

A third exemplary embodiment is an application example of the first exemplary embodiment. Description will be omitted where the portions of the third exemplary embodiment are the same as those of the first exemplary embodiment.

Depending on recording conditions and ambient conditions, temperature rising of a recording head 3 may be even greater. In the present exemplary embodiment, the main control unit 100 not only controls whether to make the wiping mechanism 8 contact a recording head 3 based on the temperature of the recording head 3, but also controls the area of contact of the wiping mechanism 8 based on the temperature of the recording head 3.

Figure 10:
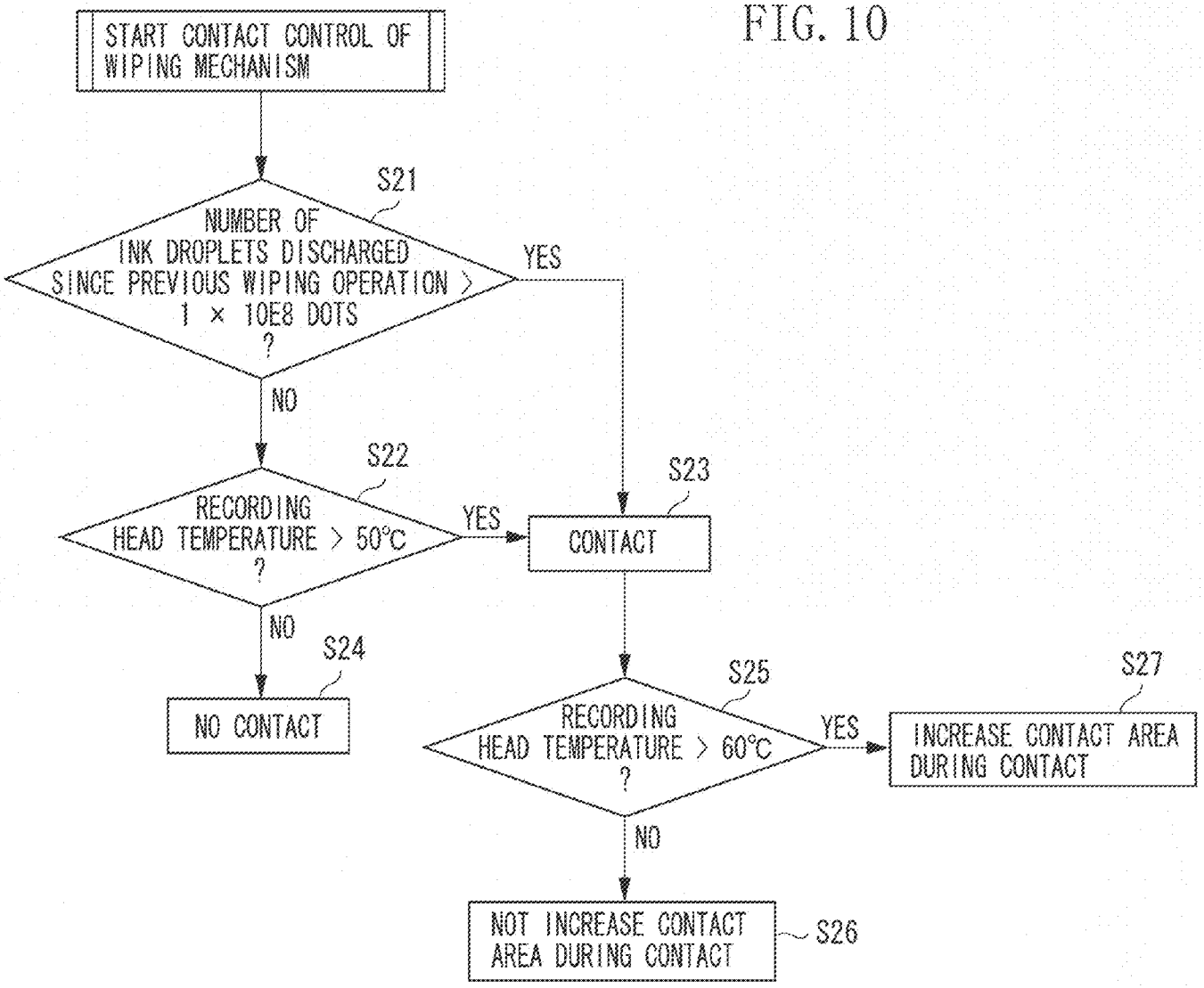
FIG. 10 is a flowchart illustrating a contact control method of a wiping mechanism according to a third exemplary embodiment.
Figure 11:
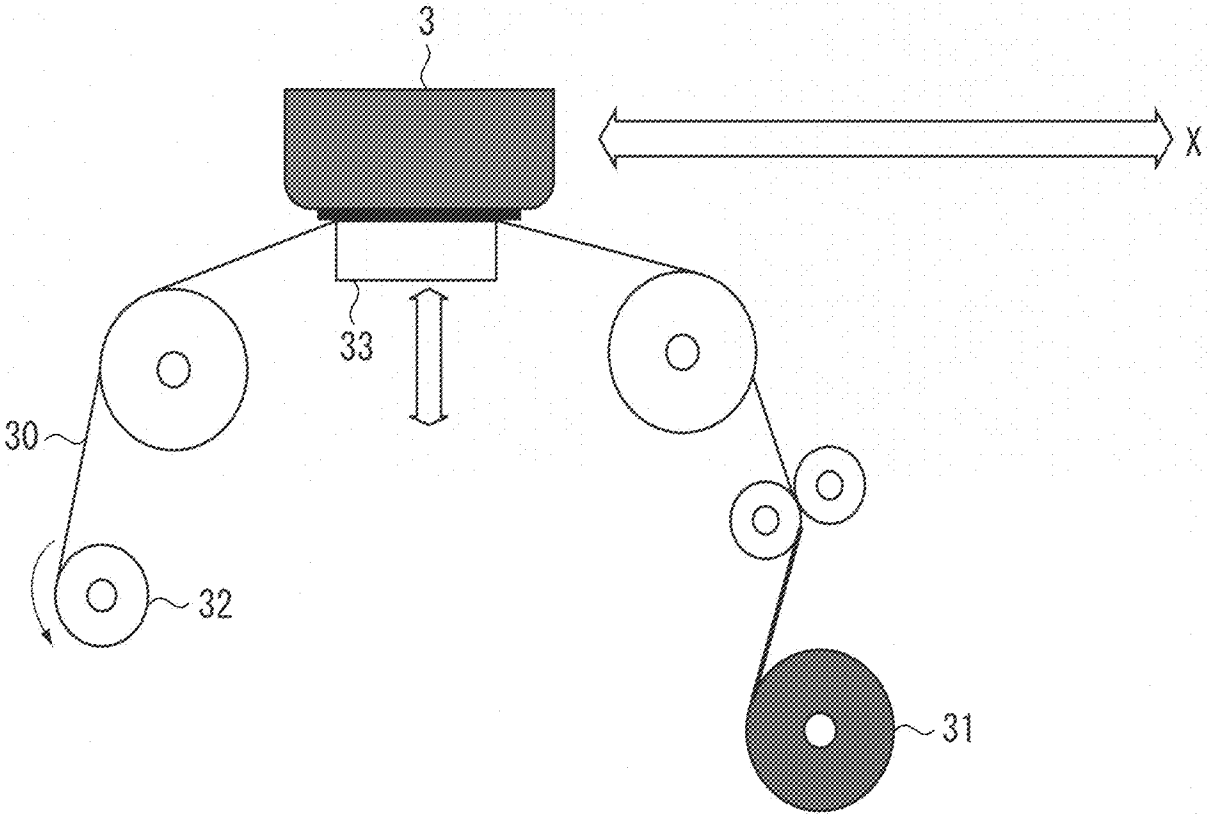
FIG. 11 is a schematic diagram illustrating the wiping mechanism according to the third exemplary embodiment.

FIG. 10 is a flowchart illustrating a control procedure according to the present exemplary embodiment. FIG. 11 is a schematic diagram illustrating a wiping mechanism 8 according to the third exemplary embodiment.

In step S21, the main control unit 100 determines whether to make the wiping mechanism 8 contact a recording head 3 based on the number of ink droplets discharged. In step S21, if the main control unit 100 determines that the wiping mechanism 8 needs to contact the recording head 3 (YES in step S21), then in step S23, the main control unit 100 controls the wiping mechanism 8 to contact the recording head 3. Otherwise (NO in step S21), the processing proceeds to step S22. In step S22, the main control unit 100 determines whether to make the wiping mechanism 8 contact the recording head 3, based on the temperature of the recording head 3. In step S22, if the main control unit 100 determines that the wiping mechanism 8 needs to contact the recording head 3 (YES in step S22), then the processing proceeds to step S23. Otherwise (NO in step S22), the processing proceeds to step S24, and the processing is ended without making the wiping mechanism 8 contact the recording head 3.

In the present exemplary embodiment, if it is determined to make the wiping mechanism 8 contact the recording head 3 (YES in step S21 or YES in step S22), then the processing proceeds to steps S23 and S25. In step S25, the main control unit 100 determines whether to increase the contact area of the wiping mechanism 8 with the recording head 3, based on the temperature of the recording head 3. In step S25, if the main control unit 100 determines to increase the contact area thereof (YES in step S25), then in step S27, the main control unit 100 controls the wiping mechanism 8 to increase the contact area thereof. Otherwise (NO in step S25), the processing proceeds to step S26 without increasing the contact area thereof.

In the present exemplary embodiment, the wiping mechanism 8 elastically deforms the abutting member 33 to change the area of contact of the abutting member 33 as illustrated in FIG. 11. The wiping mechanism 8 can thereby change the area of contact of the abutting member 33 with a recording head 3.

Figure 12:
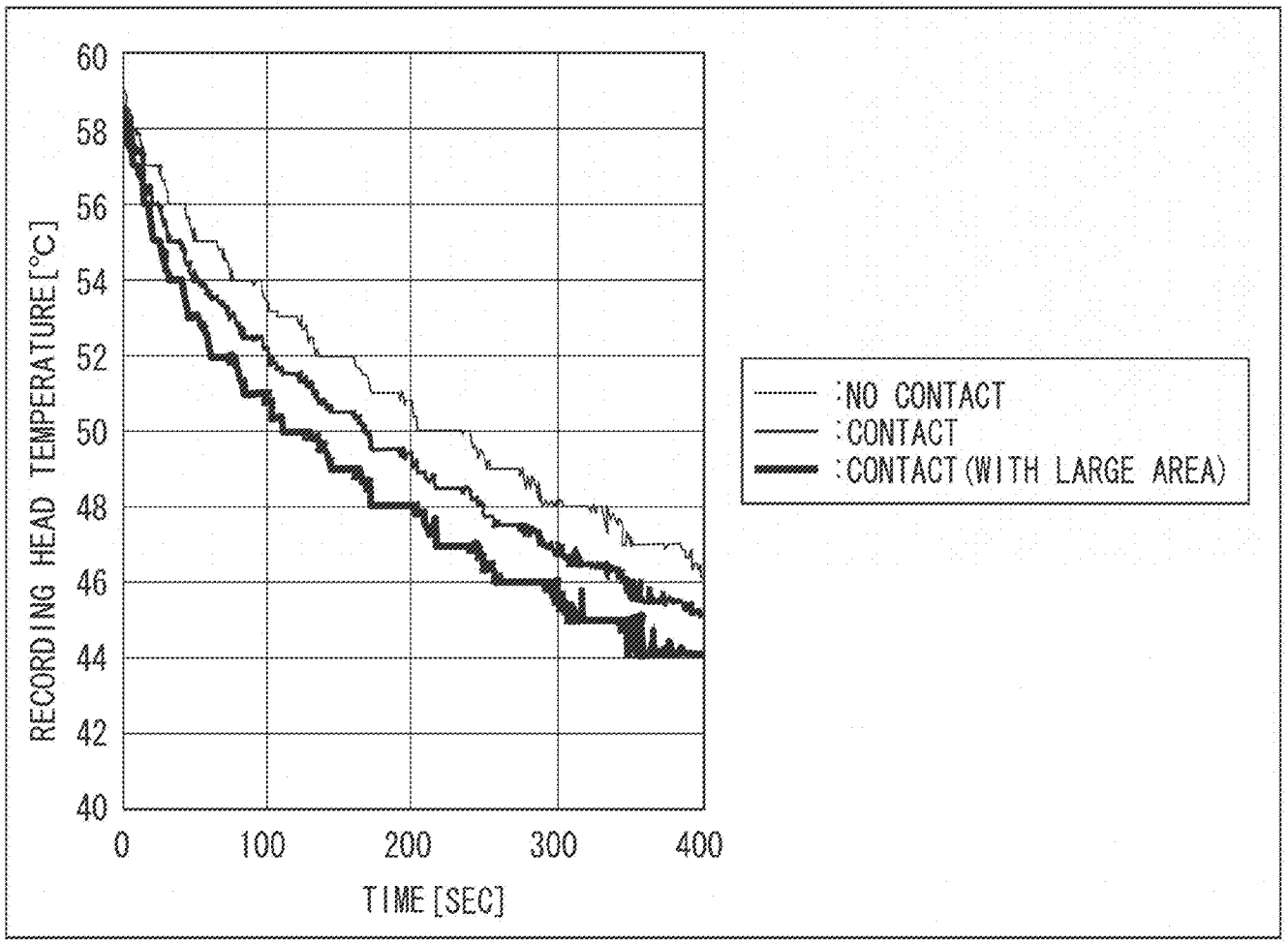
FIG. 12 is a graph illustrating temperature drops of a recording head according to a fourth exemplary embodiment.

As illustrated in FIG. 12, the area of contact with a recording head 3 can be increased to increase heat dissipation and lower the temperature of the recording head 3. The increased area of contact with a recording head 3, however, increases the amount of consumption of the cleaning web 30. The control of increasing the contact area is thus performed only when the necessity is high.

In the present exemplary embodiment, whether to make the wiping mechanism 8 contact the recording head 3 and the area of contact of the wiping mechanism 8 are controlled based on the temperature of the recording head 3. This enables effective suppression of temperature rising of the recording heads 3.

A fourth exemplary embodiment is an application example of the first exemplary embodiment. Description will be omitted where the portions of the fourth exemplary embodiment are the same as those of the first exemplary embodiment.

Depending on the material of the recording heads 3 and the material of the cleaning web 30, the contact of the cleaning web 30 against a discharge port surface 3*b* may degrade the discharge port surface 3*b*.

Figure 13:
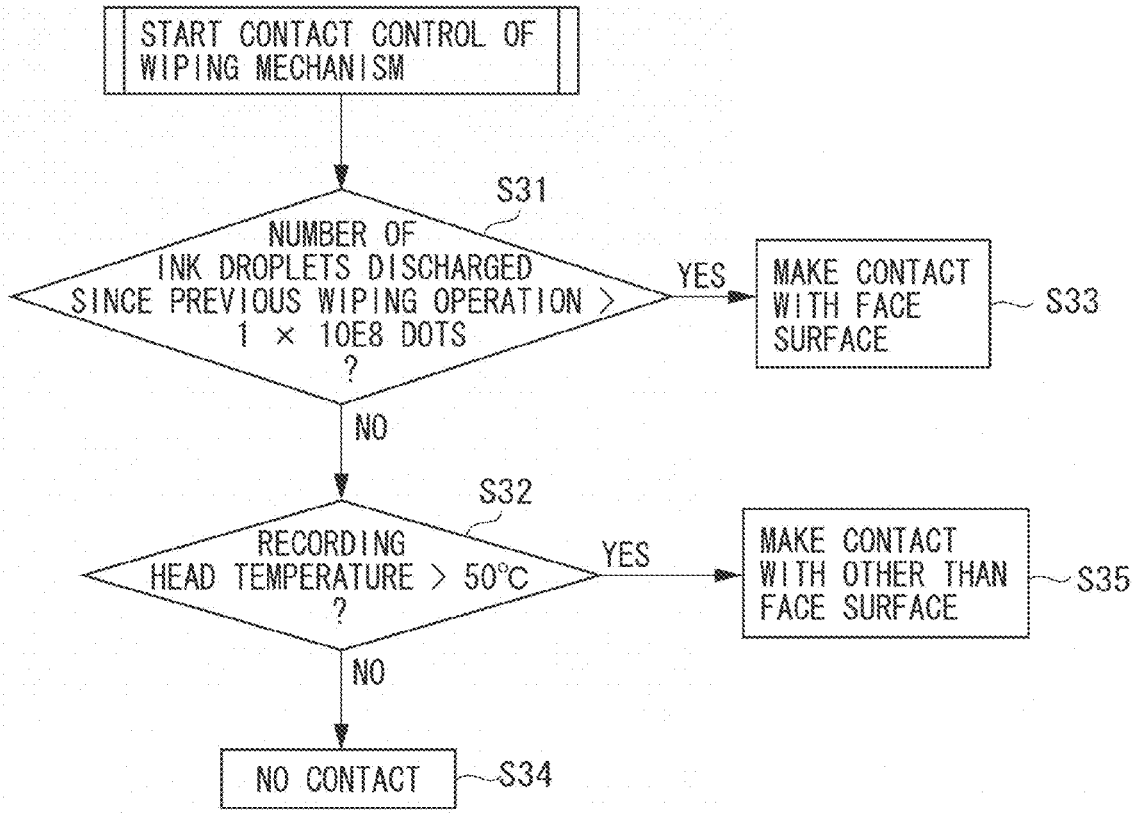
FIG. 13 is a flowchart illustrating a contact control method of a wiping mechanism according to the fourth exemplary embodiment.
Figure 14:
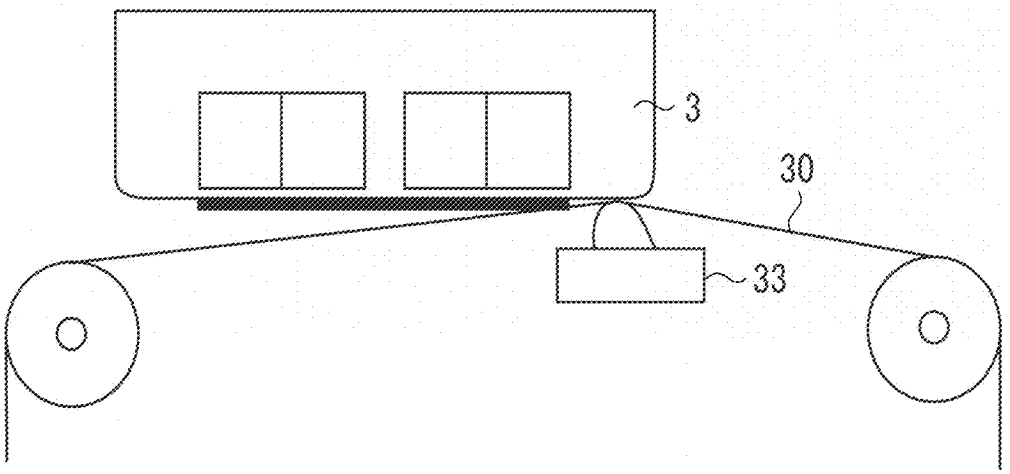
FIG. 14 is a schematic diagram illustrating a contact position of the wiping mechanism according to the fourth exemplary embodiment.

In the present exemplary embodiment, when the main control unit 100 makes the wiping mechanism 8 contact the recording head 3 based on the temperature of the recording head 3, the main control unit 100 controls the wiping mechanism 8 to make contact with a portion of the recording head 3 other than where nozzle arrays are arranged, i.e., other than the discharge port surface 3*b*. FIG. 13 illustrates a flowchart illustrating a control according to the present exemplary embodiment. FIG. 14 is a schematic diagram illustrating the contact position of the cleaning web 30.

In step S31, the main control unit 100 determines whether to make the wiping mechanism 8 contact the recording head 3 based on the number of ink droplets discharged. In step S32, the main control unit 100 determines whether to make the wiping mechanism 8 contact the recording head 3 based on the temperature of the recording head 3.

In the present exemplary embodiment, if it is determined to make the wiping mechanism 8 contact the recording head 3 based on the number of ink droplets discharged (YES in step S31), then in step S33, the control system performs control so that the wiping mechanism 8 makes contact with the discharge port surface 3*b* of the recording head 3.

If it is determined to make the wiping mechanism 8 contact the recording head 3 based on the temperature of the recording head 3 (YES in step S32), then in step S35, the control system performs control so that the wiping mechanism 8 makes contact with a portion of the recording head 3 other than the discharge port surface 3*b*.

In the present exemplary embodiment, when the main control unit 100 makes the cleaning web 30 of the wiping mechanism 8 contact the recording head 3 based on the temperature of the recording head 3, the main control unit 100 controls the wiping mechanism 8 to make contact with a portion of the recording head 3 other than the discharge port surface 3*b* as illustrated in FIG. 14. For example, the wiping mechanism 8 is controlled to make contact with the vicinity of the outer rim of the recording head 3. This makes it possible to suppress temperature rising of the recording heads 3 without degrading the discharge port surfaces 3*b* with the cleaning web 30.

A fifth exemplary embodiment is an application example of the first exemplary embodiment. Description will be omitted where the portions of the fifth exemplary embodiment are the same as those of the first exemplary embodiment.

The cleaning web 30 itself can be heated by contact with the discharge port surface 3*b* of increased temperature. This may lower the effect of the cleaning web 30 for suppressing temperature rising of the recording heads 3.

In the present exemplary embodiment, cooling fans 34 are arranged as cooling units in the vicinity of the cleaning web 30 so that the cooling fans 34 can constantly cool the cleaning web 30.

Figure 15:
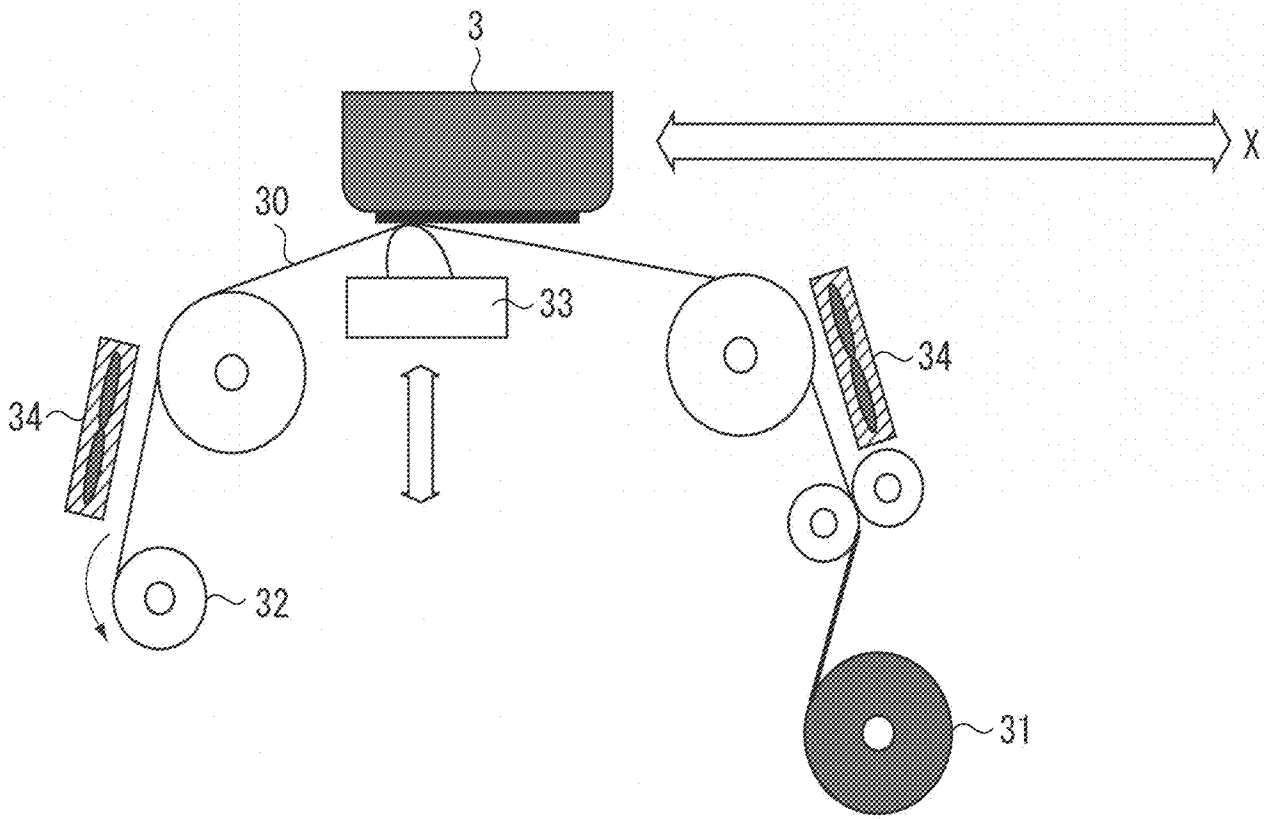
FIG. 15 is a schematic diagram illustrating positions of cooling fans according to a fifth exemplary embodiment.

FIG. 15 is a schematic diagram illustrating an arrangement of the cooling fans 34. Cooling air from the cooling fans 34 may accelerate the drying and adhesion of ink if the cooling air impinges directly on the discharge port surface 3*b* of the recording head 3. As illustrated in FIG. 15, the cooling air from the cooling fans 34 therefore needs to be prevented from impinging directly on the discharge port surface 3*b* of the recording head 3.

In the present exemplary embodiment, the cooling fans 34 constantly cool the cleaning web 30. This can improve the effect of suppressing temperature rising of the recording head 3 by the contact of the cleaning web 30 with the discharge port surfaces 3*b*.

The cooling fans 34 according to the present exemplary embodiment may be applied in combination with any of the above-described first to fourth exemplary embodiments.

A sixth exemplary embodiment is an application example of the first exemplary embodiment. Description will be omitted where the portions of the sixth exemplary embodiment are the same as those the first exemplary embodiment.

The cleaning web 30 itself can be heated by contact with the discharge port surface 3*b* of increased temperature. This may lower the effect of the cleaning web 30 for suppressing temperature rising of the recording heads 3.

The constant operation of the cooling fans 34 for cooling the cleaning web 30 as in the above-described fifth exemplary embodiment is not preferred in terms of life and power consumption of the cooling fans 34.

In the present exemplary embodiment, the cooling fans 34 and a temperature sensor 35 are arranged in the vicinity of the cleaning web 30. The cooling fans 34 serve as cooling units for cooling the cleaning web 30. The temperature sensor 35 serves as a cleaning temperature detection unit for detecting the temperature of the cleaning web 30.

In the present exemplary embodiment, the timing for the cooling fans 34 to cool the cleaning web 30 is controlled based on the temperature of the cleaning web 30 detected by the temperature sensor 35. More specifically, the control system performs control to activate the cooling fans 34 based on the temperature rising of the cleaning web 30.

Figure 16:
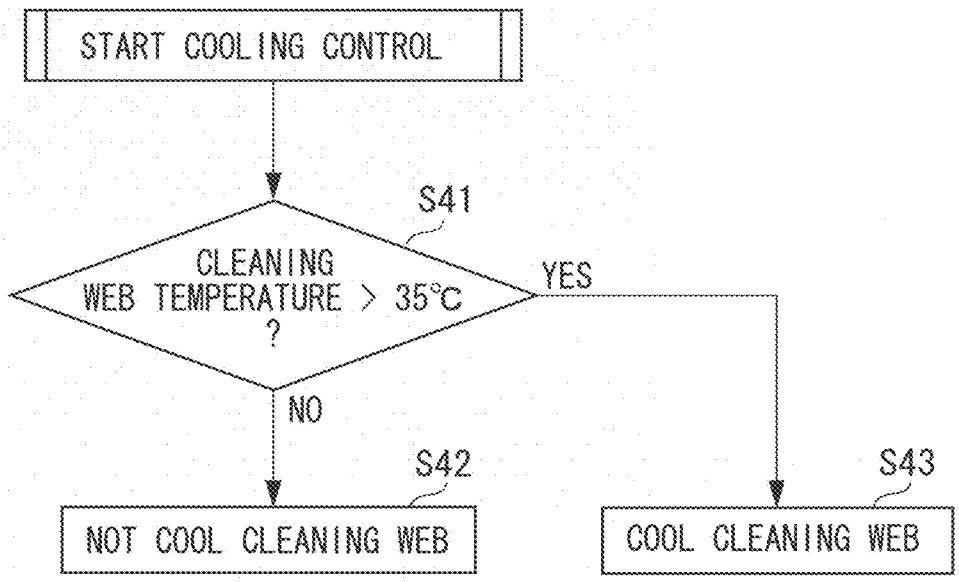
FIG. 16 is a flowchart illustrating a cooling control method according to a sixth exemplary embodiment.
Figure 17:
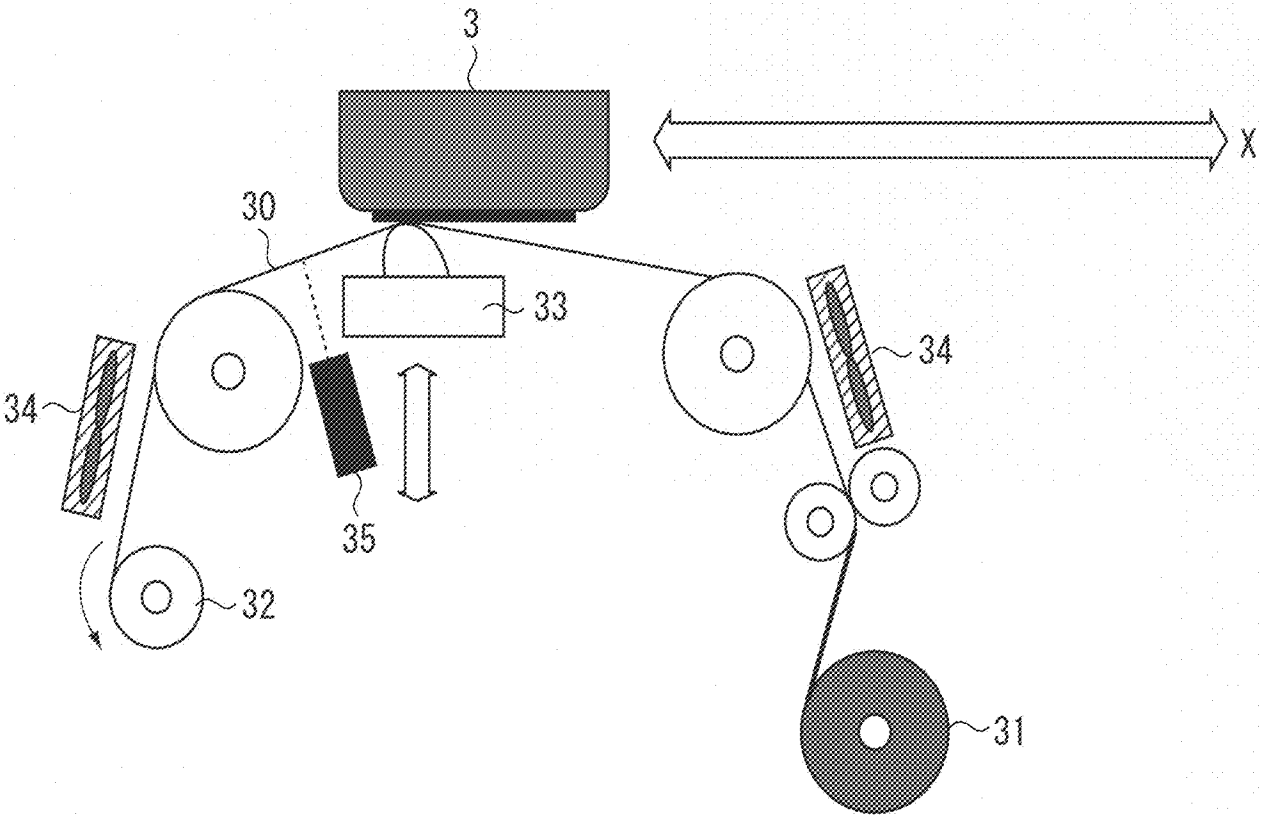
FIG. 17 is a schematic diagram illustrating a position of a temperature sensor according to the sixth exemplary embodiment.

FIG. 16 is a flowchart illustrating a control according to the present exemplary embodiment. An example of the cleaning temperature detection unit is a noncontact digital radiation temperature sensor. FIG. 17 is a schematic diagram illustrating an arrangement of the temperature sensor 35.

In steps S41 to S43, the control system performs control to activate the cooling fans 34 according to the temperature rising of the cleaning web 30. This can maintain for a long time the effect of suppressing temperature rising of the recording heads 3 by the contact of the cleaning web 30 with the discharge port surfaces 3*b*.

Figure 18:
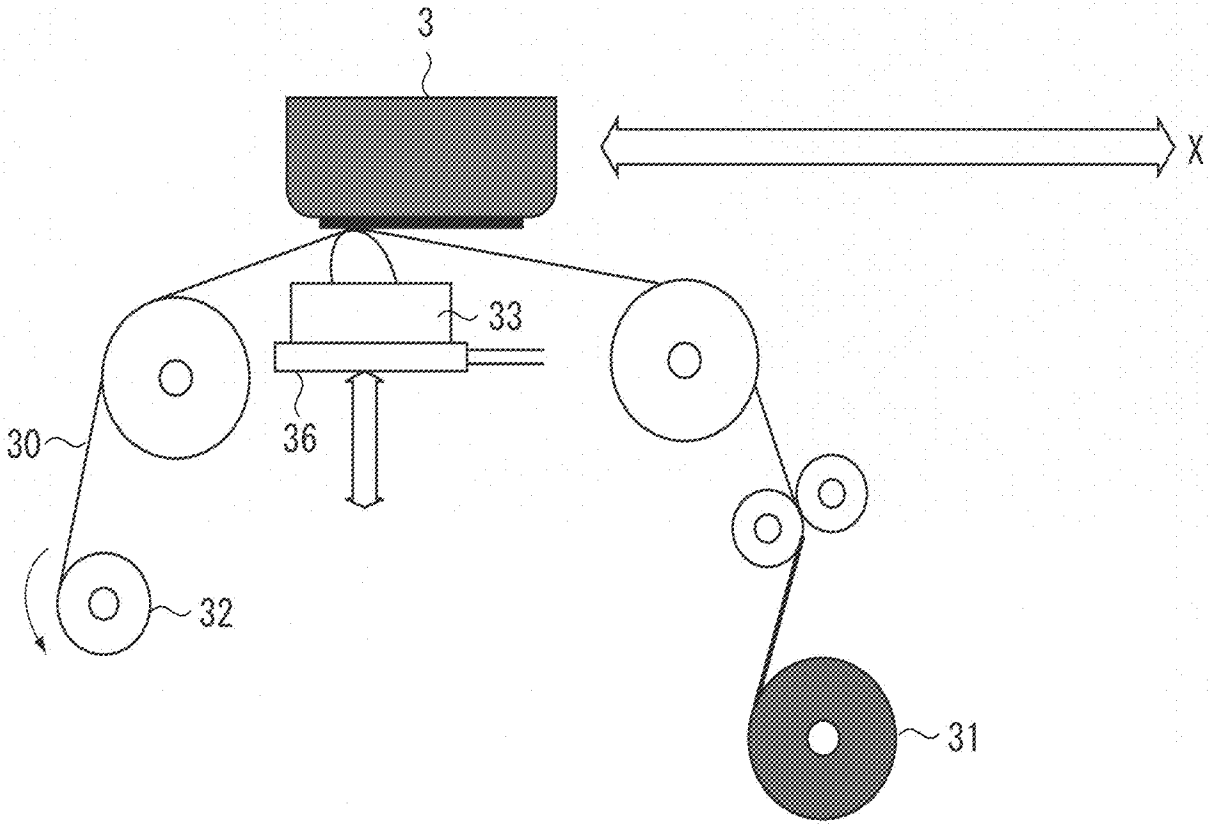
FIG. 18 is a schematic diagram illustrating a position of a Peltier device according to a seventh exemplary embodiment.
Figure 19:
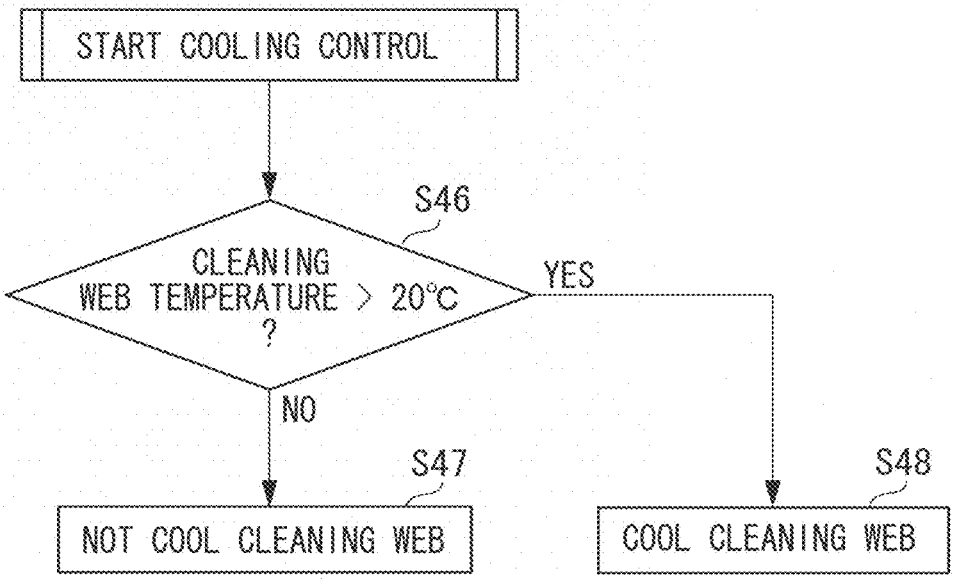
FIG. 19 is a flowchart illustrating a cooling control method according to the seventh exemplary embodiment.

A seventh exemplary embodiment is an application example of the first exemplary embodiment. Description will be omitted where the portions of the seventh exemplary embodiment are the same as those of the first exemplary embodiment. FIG. 18 is a schematic diagram illustrating an arrangement of a Peltier device according to the present exemplary embodiment. FIG. 19 illustrates a flowchart illustrating a control according to the present exemplary embodiment.

In a normal situation, the cleaning web 30 is at normal temperature. The cleaning web 30 can be cooled in advance to improve the effect of suppressing temperature rising of the recording heads 3.

In the present exemplary embodiment, as illustrated in FIG. 18, a Peltier device 36 and a cleaning temperature detection unit are arranged in the vicinity of the cleaning web 30. The Peltier device 36 serves as a cooling unit. The cleaning temperature detection unit detects the temperature of the cleaning web 30.

In steps S46 to S48, the control system performs control to cool the cleaning web 30 with the Peltier device 36 in advance based on the temperature of the cleaning web 30. The same temperature sensor 35 as in the sixth exemplary embodiment is used as the cleaning temperature detection unit. The cleaning temperature detection unit is not limited to such a configuration as long as temperature can be detected.

According to the present exemplary embodiment, the cleaning web 30 is cooled in advance depending on the temperature of the cleaning web 30. Such a control further improves the effect of suppressing temperature rising of the recording heads 3. Consequently, it is possible to reduce the number of times the cleaning web 30 makes contact with the discharge port surface 3*b*, and reduce the time duration of the contact of the cleaning web 30.

The Peltier device 36 according to the present exemplary embodiment may be applied in combination with any of the above-described first to sixth exemplary embodiments.

An eight exemplary embodiment is an application example of the first exemplary embodiment. Description will be omitted where the portions of the eighth exemplary embodiment are the same as those of the first exemplary embodiment.

Figure 20:
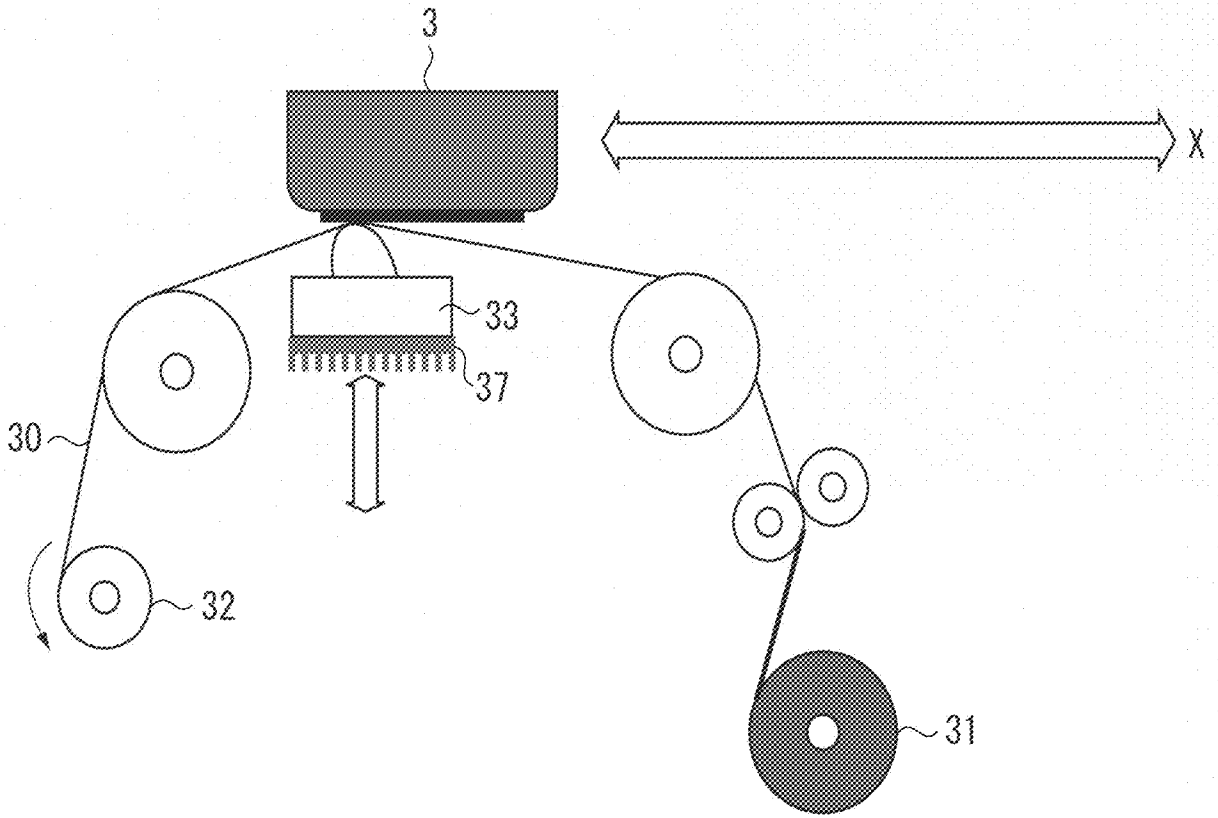
FIG. 20 is a schematic diagram illustrating a position of a radiation fin according to an eighth exemplary embodiment.

FIG. 20 is a schematic diagram illustrating an arrangement of radiation fins according to the present exemplary embodiment. The cleaning web 30 itself can be heated by contact with the discharge port surface 3*b* of increased temperature. This may lower the effect of the cleaning web 30 for suppressing temperature rising of the recording heads 3.

In the present exemplary embodiment, radiation fins 37 are attached as a heat dissipation unit to the abutting member 33 of the cleaning web 30, whereby heat dissipation of the cleaning web 30 and the abutting member 33 is accelerated.

According to the present exemplary embodiment, the provision of the radiation fins 37 for the cleaning web 30 and the abutting member 33 accelerates heat dissipation. This can maintain for a long time the effect of suppressing temperature rising caused by the contact of the cleaning web 30 with the discharge port surfaces 3*b*.

The radiation fins 37 according to the present exemplary embodiment may be applied in combination with any of the above-described first to seventh exemplary embodiments.

According to the exemplary embodiments of the present invention, temperature rising of the recording heads 3 can be suppressed by the contact of the cleaning unit with the recording heads 3 when the recording heads 3 are high in temperature. As a result, the exemplary embodiments of the present invention can suppress a drop in recording speed and degradation of image quality.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-001313 filed Jan. 6, 2011, which is hereby incorporated by reference herein in its entirety.

What is claimed is:

1. An inkjet recording apparatus comprising:

a recording head having a discharge port surface in which discharge ports for discharging ink are formed;

a counter counts an amount of ink used by the recording head;

a cleaning web performs a wiping operation of wiping the discharge port surface on the basis of a value obtained from the counter;

a detection unit detects a temperature of the recording head; and a control unit causing the cleaning web to be in contact with the discharge port surface to suppress temperature rising of the recording head without performing the wiping operation, based on the temperature detected by the detection unit.

2. The inkjet recording apparatus according to claim 1, wherein the control unit controls time duration to cause the cleaning web to contact the discharge port surface based on the temperature detected by the detection unit.

3. The inkjet recording apparatus according to claim 1, wherein the control unit controls a contact area of the cleaning web with the discharge port surface based on the temperature detected by the detection unit.

4. The inkjet recording apparatus according to claim 1, wherein the control unit causes the cleaning web to contact a portion of the discharge port surface where temperature is relatively high.

5. The inkjet recording apparatus according to claim 1, wherein the control unit causes the cleaning web to contact a portion of the recording head other than the discharge port surface.

6. The inkjet recording apparatus according to claim 1, further comprising a cooling unit for cooling the cleaning web.

7. The inkjet recording apparatus according to claim 6, further comprising a second detection unit for detecting temperature of the cooling unit, wherein the control unit controls whether to cool the cleaning web with the cooling unit based on the temperature detected by the second detection unit.

8. The inkjet recording apparatus according to claim 1, further comprising a heat dissipation unit for dissipating heat of the cleaning web.

9. The inkjet recording apparatus according to claim 1, further comprising a changing unit changing an area of the cleaning web which wipes the discharge port surface.

10. The inkjet recording apparatus according to claim 9, wherein the changing unit comprises a feed roller that feeds the cleaning web and a winding roller that winds the cleaning web.

* * * * *